US005172711A

United States Patent [19]

Mueller et al.

[11] Patent Number: 5,172,711

[45] Date of Patent: Dec. 22, 1992

[54] COMBINATION CANOPY AND FAN

[76] Inventors: Erna Mueller, 3015 - 127th Pl. SE., Bellevue, Wash. 98005; James Moores, 16020 Old Snohomish Hwy., Snohomish, Wash. 98290

[21] Appl. No.: 738,786

[22] Filed: Jul. 31, 1991

[51] Int. Cl.[5] ..... A45B 3/00

[52] U.S. Cl. ..... 135/16; 135/20.3

[58] Field of Search ..... 135/16, 15.1, 19, 20.3; 74/421 A, 606 R

[56] References Cited

U.S. PATENT DOCUMENTS

| | | | |
|---|---|---|---|
| 1,148,332 | 7/1915 | Onyskow | 135/16 |
| 1,532,802 | 4/1925 | Feistner | 135/16 |
| 1,555,579 | 9/1925 | Howell | 135/16 |
| 2,547,896 | 4/1951 | Wellen | 135/16 |
| 2,627,217 | 2/1953 | Hainke et al. | 135/16 X |
| 2,729,220 | 1/1956 | Smyrnow | 135/16 |
| 3,177,881 | 4/1965 | Covington | 135/16 |
| 4,154,255 | 5/1979 | Weaver | 135/16 |
| 5,007,811 | 4/1991 | Hopkins | 135/16 |

FOREIGN PATENT DOCUMENTS

| | | | |
|---|---|---|---|
| 2617689 | 1/1989 | France | 135/16 |

*Primary Examiner*—David A. Scherbel
*Assistant Examiner*—Lan Mai
*Attorney, Agent, or Firm*—Christensen, O'Connor, Johnson & Kindness

[57] ABSTRACT

A combination canopy and fan (10), including an elongate shaft (16), a collapsible, domed canopy (12) mounted on the upper end of the shaft, and a fan assembly (18) mounted on the shaft under the canopy. The fan assembly (18) includes a fan hub (20) mounted axially and rotatably on the shaft, a plurality of fan blades (22) pivotally secured to the fan hub, and a drive motor (24) secured externally to the shaft adjacent the fan hub for driving rotation of the fan hub. The combination canopy and fan includes a power supply source (26) powering the drive motor.

6 Claims, 5 Drawing Sheets

COMBINATION CANOPY AND FAN

TECHNICAL FIELD OF THE INVENTION

The present invention relates to canopies for shielding people from the weather, and more particularly to a combination canopy and fan for protecting the user from sun or rain and providing a ventilation air stream for comfort.

BACKGROUND OF THE INVENTION

People in many parts of the world sit under or carry canopies to protect them from the extremes of the weather. For instance, in sunny temperate climates, people often sit under beach umbrellas or carry portable parasols to protect them from the heat of the sun. In other portions of the world, people often carry umbrellas to protect them from precipitation. In either case, it is desirable to provide a ventilation stream of air flowing through the canopy to prevent the buildup of hot air under the canopy, blow away insects, and provide some relief from humidity.

Umbrellas including integral electric fans are known in the art to provide a ventilation air stream flowing through the umbrella. However, these prior art combination umbrellas and fan have been either too complex and costly to assemble, or inconvenient to operate.

One example of a conventional combination umbrella and fan is provided by U.S. Pat. No. 1,148,332 to Onyskow. The disclosed combination umbrella includes a two-part hollow umbrella rod joined by a rotatable fan hub assembly. A conventional umbrella canopy is supported by the upper half of the hollow rod. A motor and battery is housed within a hollow handle mounted to the lower end of the rod. A drive shaft extends from the motor, up through the lower half of the hollow rod, to drive rotation of the fan hub. This construction of a multi-component hollow rod with separate internal drive shaft renders the umbrella costly to produce, both in terms of material and labor. The umbrella also includes two fan blades which are hingedly connected to the fan hub assembly. To close the umbrella, the blades must first be manually folded upwardly against the umbrella rod prior to folding the canopy. This operation is unduly burdensome to many potential users.

Another example of a conventional umbrella and fan combination is disclosed by U.S. Pat. No. 3,177,881 to Covington. A motor is journaled on an intermediate umbrella rod section, which is joined between upper and lower rod sections. Two fan blades are pivotally secured to a rotatable housing that surrounds the motor. Batteries housed within the umbrella handle power the motor. Again, this multi-pieced rod construction is costly and complex to produce. The fan blades are biased by springs to a radially extended position for operation of the fan. When the canopy is collapsed, stays bear against the fan blades to overcome the biasing force of the springs and fold the blades downwardly against the umbrella rod. Thus, a user must exert sufficient force in closing the umbrella to overcome the force of the fan blade springs, which may prove difficult for frail users.

SUMMARY OF THE PRESENT INVENTION

The present invention provides an improved combination canopy and fan that is relatively inexpensive to produce an simple and convenient to operate. The combination canopy includes an elongate shaft, a domed canopy mounted axially on the upper end of the shaft, and a fan assembly mounted on the shaft under the canopy. The fan assembly includes: a fan hub mounted axially and rotatably on the shaft; a plurality of fan blades secured to the fan hub and extendable radially outward therefrom; and, a drive motor secured externally to the shaft adjacent the fan hub for driving rotation of the fan hub. A power supply powers the drive motor.

In a preferred embodiment, the canopy shaft is of unitary construction. The drive motor includes a drive pulley that is positioned adjacent a driven pulley secured axially on the fan hub. The drive pulley is trained with the driven pulley to operate the fan.

In a further aspect of the present invention, the fan blades are pivotally secured to the fan hub and are biased upwardly alongside the shaft in a folded position. Centrifugal forces resulting from operation of the fan hub cause the fan blades to pivot outwardly from the hub into an extended position. The fan blades are automatically returned to an upwardly folded position when operation of the fan assembly is interrupted by the user. The user can thus collapse the canopy without having to first manually fold the blades or overcome resistance generated by fan blade springs.

The combination canopy and fan of the present invention is constructed from common mechanical parts mounted externally on a unitary shaft, and thus is relatively inexpensive to produce. Operation of the umbrella is both simple and convenient, thus making the umbrella a convenience, rather than a hindrance, to use.

BRIEF DESCRIPTION OF THE DRAWINGS

The invention will presently be described in greater detail, by way of example, with reference to the accompanying drawings, in which.

DETAILED DESCRIPTION OF THE PREFERRED EMBODIMENTS

Figure 1:
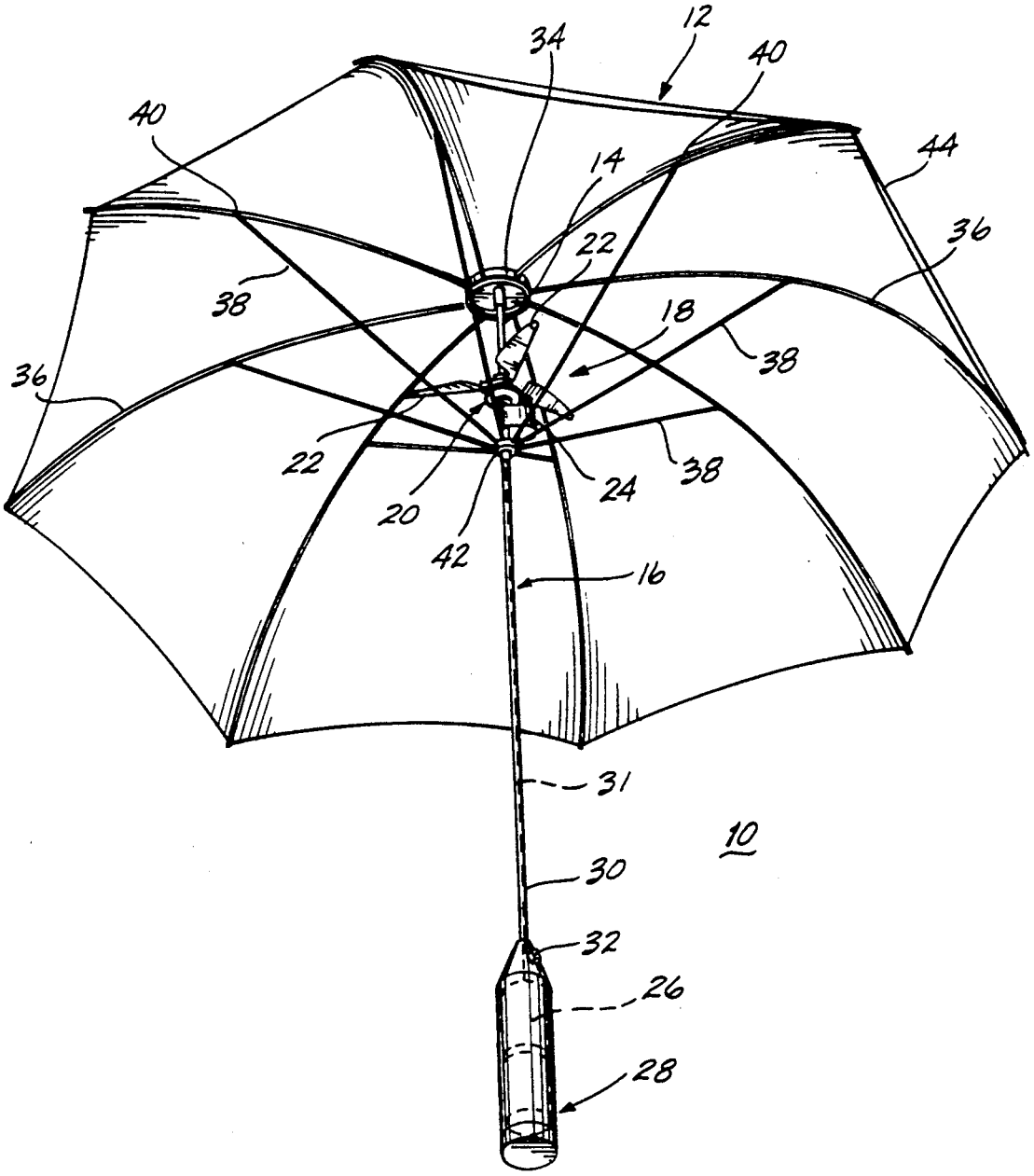
FIG. 1 is a pictorial view of the underside of a combination canopy and fan constructed in accordance with the present invention.

A preferred embodiment of a combination canopy and fan, denoted generally as umbrella 10, is shown in FIG. 1. The umbrella 10 illustrated is portable so it can be used as a rain umbrella or a parasol. The umbrella 10 includes a collapsible canopy 12 mounted axially to the upper end 14 of an elongate central shaft 16. A fan assembly 18 is mounted on the shaft 16 under and within the dome created by the canopy 12. The fan assembly 18 includes a rotatable fan hub 20 to which a plurality of fan blades 22 are pivotally secured. A small electric motor 24 is secured externally alongside the shaft 16, adjacent and immediately below the fan hub 20, to drive rotation of the fan hub 20 and fan blades 22. One or more batteries 26 are housed within a hollow handle 28, secured to the lower end 30 of the shaft 16, to power the motor 24.

The umbrella shaft 16 preferably has a unitary construction, and comprises a single length of hollow tubing that extends from the handle 28 to the upper center of the canopy 12. Wires 31, connected to the batteries 26 in the handle, pass upwardly through the hollow shaft 16, exit the shaft through a passage (not shown) formed in the shaft adjacent the motor 24, and are connected to the motor 24. A momentary, normally off switch 32 is mounted on the handle 28 and is suppressible by a person carrying the umbrella to supply power from the batteries 26 to the motor 24 for operation of the fan assembly 18.

Figure 2:
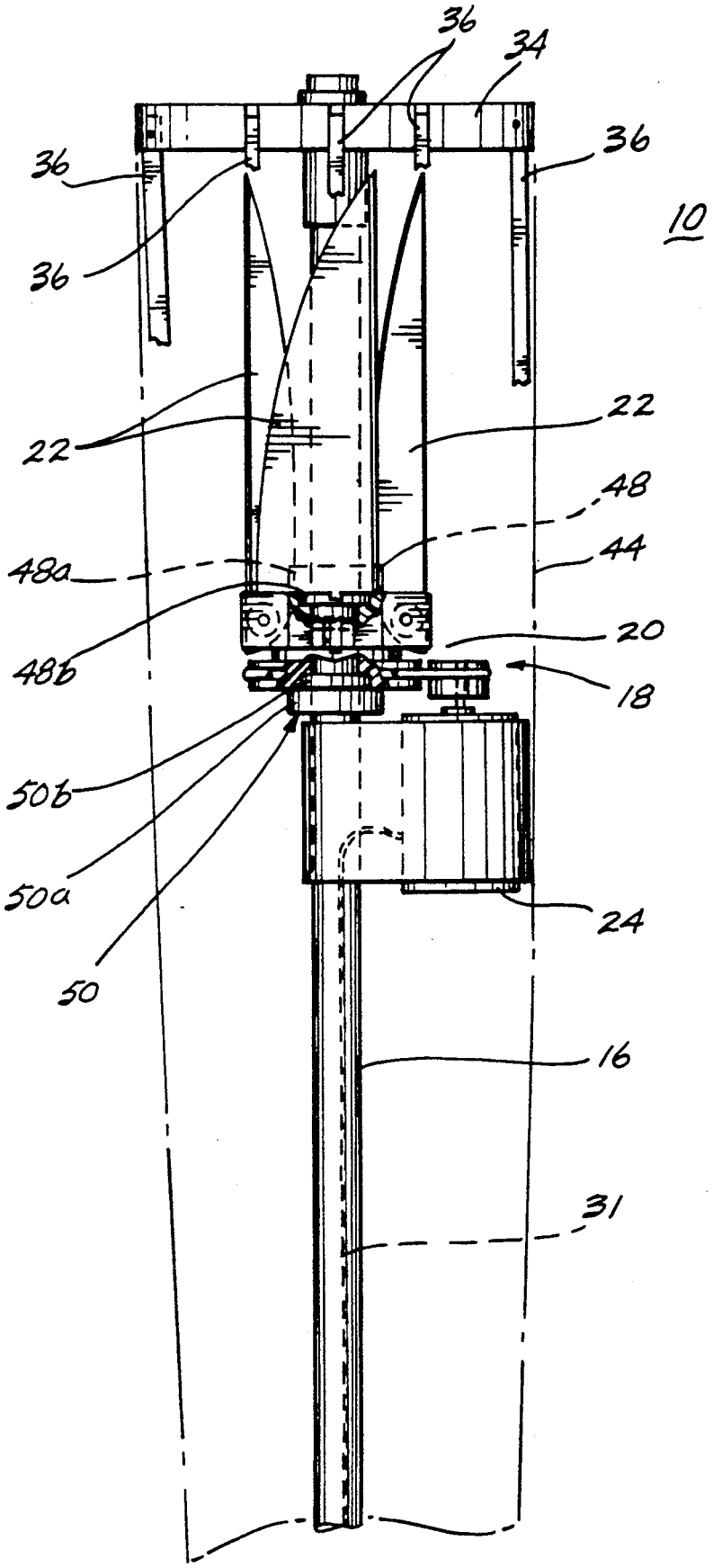
FIG. 2 is a partial side elevation view of the combination canopy and fan of FIG. 1 in the collapsed configuration, with the majority of the collapsed canopy removed for clarity.

The canopy 12 is conventionally constructed, with one notable exception. Referring to FIGS. 1 and 2, an enlarged canopy mounting disk 34 is secured axially to the uppermost tip of the upper end 14 of the shaft 16. The canopy mounting disk 34 has a predetermined perimetrical diameter sufficient to enable the canopy 12 to collapse smoothly around the fan assembly 18 when the umbrella is closed, as shown in FIG. 2. More specifically, the diameter of the disk 34 is at least as large as, and preferably substantially equal to, the overall diameter of the fan assembly 18, including the motor 24, when the fan blades 22 are folded against the shaft 16, as shall be described subsequently.

The umbrella canopy 12 is secured coaxially to the outer perimeter of the canopy mounting disk to mount the canopy 12 on the upper end 14 of the shaft 16. The canopy 12 includes a conventional arrangement of radially extending elongate main stays 36 and a corresponding number of shorter elongate support stays 38. Each of the main stays 36 has an inner end pivotally secured to the outer perimeter of the disk 34, and an outer end that is extendable radially outward from the shaft 16.

Each of the support stays 38 has an outer end that is pivotally secured, by pinning or other conventional means, to a corresponding main stay 36 at a point between intermediate the ends of the main stay. The inner end of each support stay 38 is pivotally secured to a slide collar 42 that is slidably and axially engaged over the central shaft 16, below the fan assembly 18. A flexible web covering 44 covers, and spans between, the upper surface of the main stays 36. The covering 44 is secured at its center to the disk 34 and around its perimeter to the outer ends of the main stays 36.

The slide collar 42 may be manually slid to an upper position, as shown in FIG. 1, in which the umbrella is open and the covering 44 and main stays 36 form a dome. The slide collar 42 may be selectively secured in this upper position by a conventional spring-loaded catch (not shown).

Referring to FIG. 2, the slide collar 42 may be slid downwardly along the shaft 16 to a lower position to draw the support stays 38 and main stays 36 down until they are folded against the shaft 16. FIG. 2 shows the upper end of the umbrella 10 with the canopy 12 in this collapsed, closed configuration. The main stays 36 and covering 44 are shown broken away for clarity in viewing the fan assembly 18. In this collapsed configuration, because of the enlarged diameter of the disk 34, the canopy covering 44 is neatly folded over the fan assembly 18, without extreme bulges being evident from the outside of the umbrella.

The fan blades 22 are pivotable upwardly from an extended position, in which the fan assembly 18 is operable, as shown in FIG. 1, to a folded position, as shown in FIG. 2. In the folded position, the fan blades 22 are disposed essentially parallel to and alongside the upper end 14 of the shaft 16, enabling collapsing of the umbrella 10.

Figure 3:
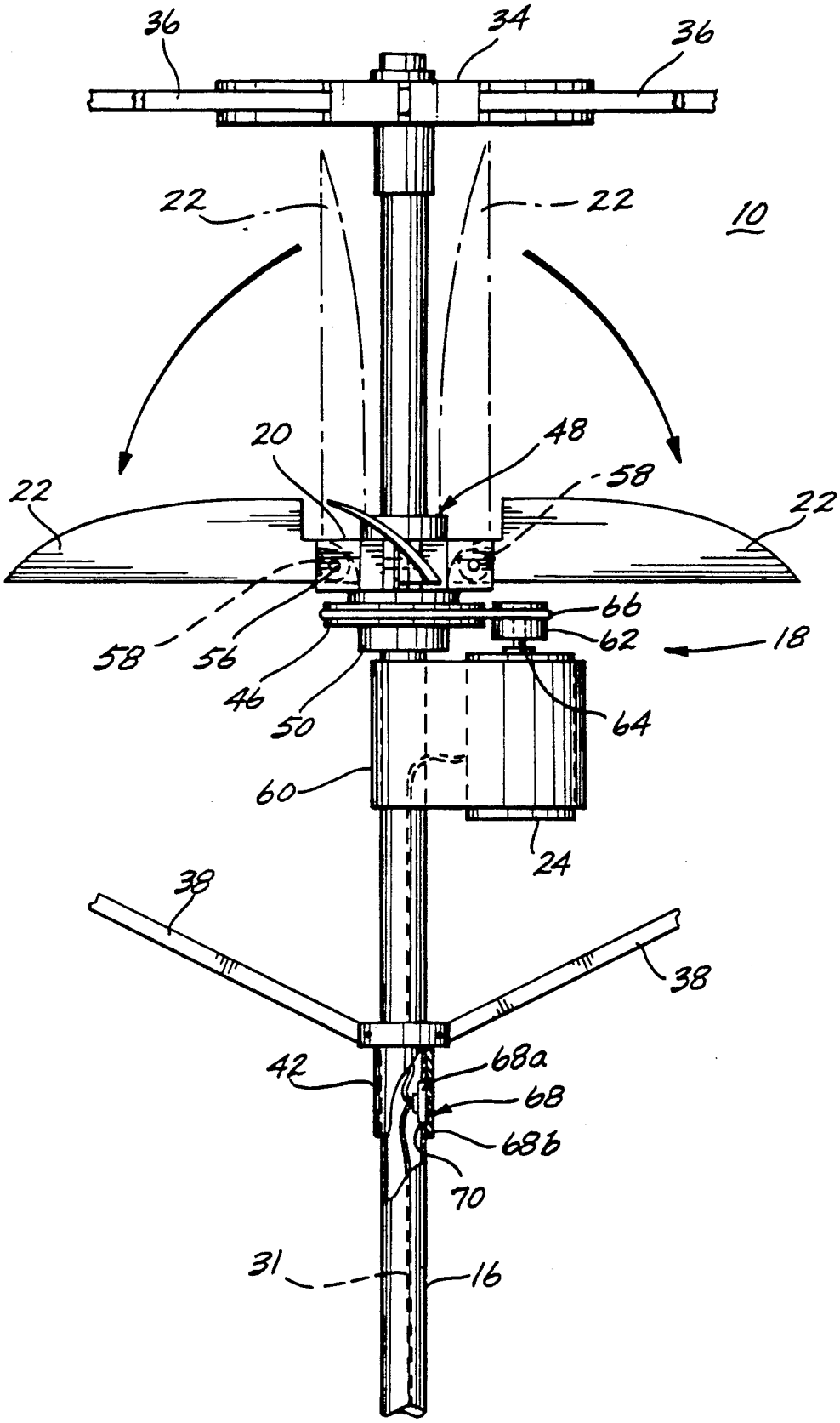
FIG. 3 is a partial, side elevation view corresponding to FIG. 2 but with the canopy opened and the fan blades in the extended position, with the fan blades also shown in the folded position in phantom.
Figure 4:
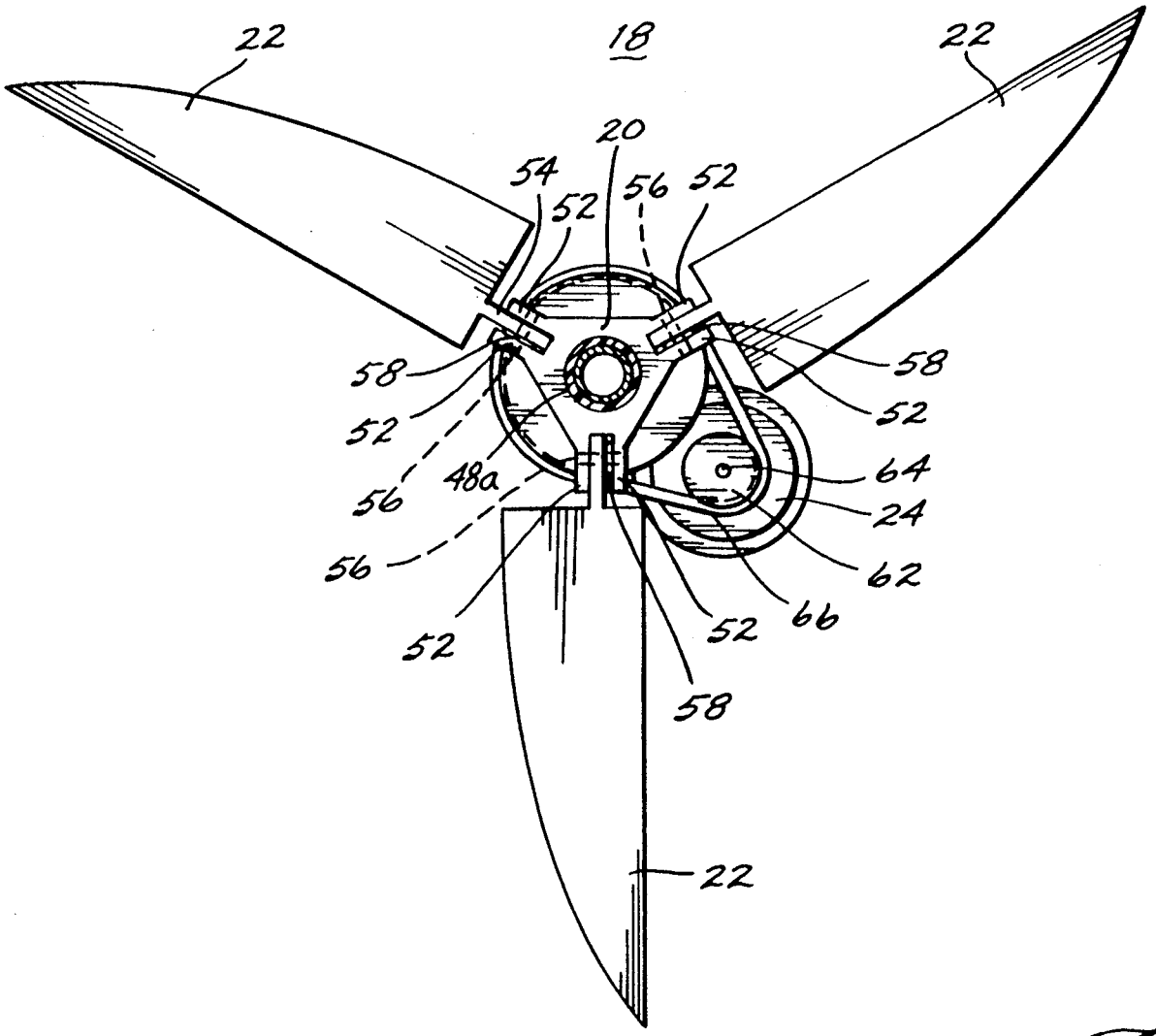
FIG. 4 is a plan view looking down upon the fan hub assembly and drive motor, with the blades shown in the extended position.

Referring next to FIGS. 3 and 4, the construction of the fan assembly 18 is described in greater detail. The fan hub 20 is axially secured to a driven pulley 46 by screws, adhesive or other conventional fasteners. Alternatively, the driven pulley 46 and fan hub 20 can be molded or otherwise formed as a single integral piece to lower the production costs. The fan hub 20 and driven pulley 46 include aligned central passageways (not shown) for receiving the shaft 16. An upper thrust bearing 48 is installed on the shaft 16 above the fan hub 20. The bearing 48 has a step-down portion 48*a* that is received within the central opening of the fan hub 20 and a shoulder portion 48*b* that contacts the upper surface of the hub 20. A corresponding lower thrust bearing 50 has a step-down portion 50*a* received within the central opening fo the driven pulley 46 and a shoulder portion 50*b* that contacts the lower surface of the driven pulley 46. The upper and lower thrust bearings 48 and 50 are secured to the shaft 16 to prevent sliding along the shaft, thus capturing the assembled fan hub 20 and driven pulley 46 therebetween. The thrust bearings 48 and 50 are preferably constructed from a low friction material such as a nylon plastic. The assembled fan hub 20 and driver pulley 46 thus rotate on the step-down portions of the thrust bearings 48 and 50. It should be readily apparent that other conventional bearings, such as roller bearings, could be used in place of the thrust bearings 48 and 50. Alternatively, the fan hub 20 and driver pulley 46 can be constructed from a self-lubricated material such as carbon filled thermoplastic, and the bearings 48 and 50 would then be replaced by retaining collars.

Referring to FIG. 4, the fan hub 20 has a generally triangular construction. The fan hub 20 includes three sets of radially outward projecting flange pairs 52 formed at each of its three corners. A mounting flange 54 projects from the inward end of each of three fan blades 22 and is pivotally secured between a corresponding pair of flanges 52 by a cross pin 56. Although three fan blades has been found very effective in producing a ventilation breeze, it should be apparent that other numbers of blades, such as two or four blades, could be utilized instead.

Referring to FIGS. 3 and 4, a torsion spring 58 is mounted on each pin 56 and has a first end (not shown) anchored in the fan hub 20 and a second end (not shown) anchored in a corresponding fan blade 22. Referring to FIG. 3, the torsion springs 58 bias the fan blades 22 upwardly to a nominally folded position, shown in phantom line, alongside the shaft 16. When the fan is not operated, the fan blades 22 are maintained in this folded position by the force of the springs 58, allowing closing of the umbrella, and non-ventilated use of the umbrella. When the fan is operated by rotation of the driven pulley 46 and fan hub 20, centrifugal forces are generated that act to draw the blades 22 downwardly to their extended positions, as shown in the solid lines in FIG. 3. In their extended position, the fan blades 22 are oriented substantially perpendicular to the shaft 16.

Referring still to FIGS. 3 and 4, the motor 24 is secured by a clamp 60 externally of and alongside the shaft 16, immediately below the driven pulley 46. Alternatively, the motor 24 can be secured to the shaft by being captured in a molded plastic split casing to protect the motor from moisture and to reduce operating noise.

A drive pulley 62 is axially secured to the end of a drive shaft 64 projecting upwardly from the motor 24. The drive shaft 64 is oriented generally parallel to the central axis of the umbrella shaft 16. The drive pulley is positioned radially outward from, and in adjacent alignment with, the driven pulley 46. A belt 66 drivingly engages the drive pulley 62 with the driven pulley 46. A rubber o-ring has been found suitable for this purpose. The motor has sufficient torque and operating speed to rotate the fan hub 20 at a speed of at least 1,000 revolutions per minute, and preferably approximately 2,000 revolutions per minute. At this speed and with the fan configuration described above, the fan assembly 18 generates a downwardly expanding column of air to cool the face and shoulders of a person carrying the umbrella.

Referring to FIG. 3, the umbrella 10 includes an interrupt switch assembly 68. The interrupt switch 68 includes a first electrical contact 68*a* mounted within an opening 70 formed in the sidewall of the shaft 16. At least one wire of the wiring 31 between the motor 24 and the battery 26 is connected to, and open-circuited at, the first contact 68*a*. A second electrical contact 68*b* consists of a conductive insert mounted within the inside of the slide collar 42. When the slide collar 42 is in the upper position, with the canopy 12 fully opened, the conductive second contact 68*b* contacts the first contact 68*a* to close the circuit in the wiring 31, permitting power to be supplied to the motor 24. When the slide collar 42 is moved downwardly away from the upper position to close the umbrella canopy 12, the second contact 68*b* no longer contacts the first contact 68*a*, and power supply to the motor 24 is interrupted. Thus, inadvertent operation of the fan assembly 18 is prevented except for when the umbrella 10 is fully opened.

Figure 5:
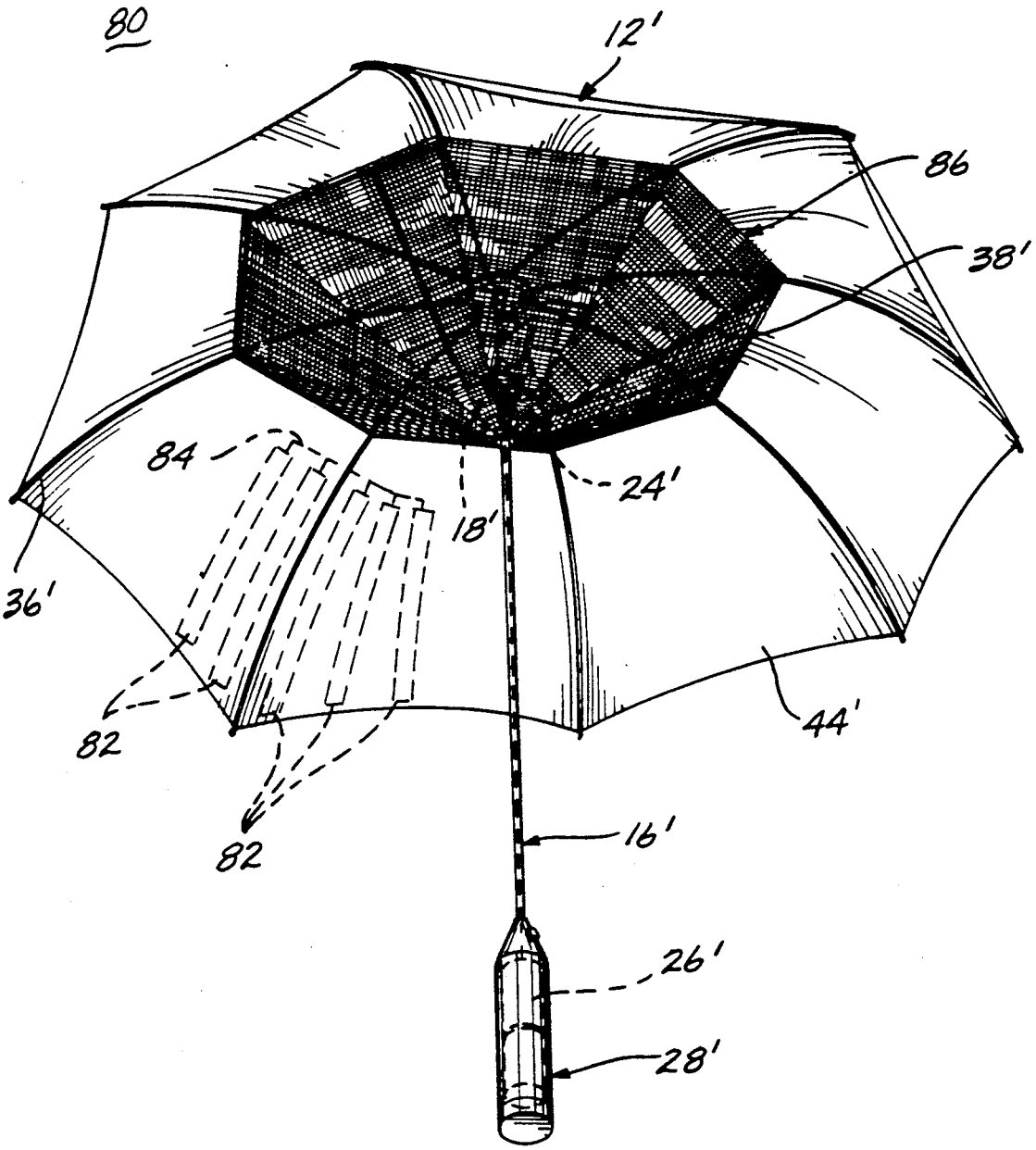
FIG. 5 is a pictorial view of the underside of an alternate embodiment of a combination canopy and fan constructed in accordance with the present invention and including a mesh screen to prevent entanglement of the user with the fan.

An alternate embodiment of a combination canopy and fan umbrella 80 constructed in accordance with the present invention is shown in FIG. 5. The umbrella 80 is constructed identically to the umbrella 10 previously described, with the exception of several additional features. To avoid repetition, the features in common will not be described in detail and will be indicated with the same reference numeral as used for umbrella 10, but with the addition of a prime (′). The umbrella 80 includes a canopy 12′ mounted on the upper end of a shaft 16′. Batteries 26′ in a handle 28′ power a motor 24′ which drives rotation of a fan assembly 18′.

In addition to the batteries 26′, the fan 80 also includes an alternate power source consisting of a plurality of photovoltaic solar panels 82 mounted on the upper surface of the covering 44′ of the canopy 12′. The solar panels 82 are arranged on the cover 44′ between the main stays 36′. The exact number and arrangement of the solar panels 82 depends on the electricity generating capacity of the solar panels 82. The solar panels 82 are elongated, are narrower than the tangential distance between main stays 36′, and are oriented radially relative to the shaft 16′, thus enabling the umbrella 80 to be collapsed. Alternatively, larger flexible or hinged solar panels could be used.

The solar panels generate electricity to operate the motor 24′ in sunny climates. The solar panels 82 are connected by wiring 84 secured to one of the main stays 36′ on the underside of the umbrella canopy 12′. Wiring 84 is either directly connected to the motor 24′ to drive the motor directly, or may be wired to a voltage-sensing switch, not shown, that connects the motor with either the solar panels or batteries depending on the voltage generated by the solar panels. The power generated by the solar panels 82 may either augment the power generated by the batteries 26′, or may substitute for the power generated by the batteries 26′, depending on the electrical configuration of the umbrella 80.

Additionally, the batteries 26′ may be rechargeable, and the electricity generated by the solar panels 82 used to recharge the batteries 26′ during use. Finally, the batteries 26′ may be completely eliminated to reduce the handle weight of the umbrella 80, with all power being supplied by the solar panels 82. This type of arrangement would be suitable for sunny climates where the umbrella 80 is used mainly as a shade parasol.

The umbrella 80 also includes a mesh material screen, such as a screen 86 mounted to the underside of the support stays 38′. The screen 86 spans between and is secured to the underside of each of the support stays 38′, forming an upwardly concave shield around the fan assembly 18′. The fan assembly 18′ is thus surrounded on the upper side by the covering 44′ and on the lower side by the screen 86. The purpose of the screen 86 is to prevent entanglement of a user's hair or fingers with the fan assembly 18, while permitting free passage of the ventilation air produced by the fan assembly 18′ through the screen 86. The screen 86 is formed from a loosely woven material that defines a plurality of openings for free passage of air therethrough. Further, the screen 86 is flexible to allow collapse of the umbrella 80.

Although the present invention has been described in terms of preferred embodiments 10 and 80, other variations of a combination canopy and fan can be constructed in accordance with the present invention. For example, an umbrella may be constructed similar to the umbrella 80 but including only the solar panels 82 or the screen 86.

Although the preferred embodiments described thus far have been configured as portable hand-held umbrellas, it should be readily apparent that larger combination canopies and fans can be constructed in accordance with the present invention. For example, a larger version of the umbrellas 10 or 80 could be constructed for use as a beach umbrella or for securement to tables to shade and protect people sitting at the tables. These larger combination canopy and fans would be constructed similarly to the umbrellas 10 or 80, but would not include a handle. Further, as larger solar panels could be utilized, it would not be necessary to include batteries for umbrellas to be used in sunny climates, with electricity generated by the solar panels supplying all power to the fan. Additionally, an umbrella similar to umbrella 10 or 80 could be constructed which would include a clamp, rather than a handle, for attachment to a wheelchair for a disabled person's use.

As a further example of an alternative embodiment, rather than the pulley and belt drive of umbrella 10, other conventional drive mechanisms could be utilized. For example, the motor could include a drive pinion that engages with and drives a driven gear on the fan assembly. Alternatively, a friction drive where the motor drives a frictional roller that engages with the outer periphery of a frictional disk included on the fan hub could be utilized.

Although the umbrella 10 and 80 have been shown with a single motor 24, it should be apparent that two or more smaller motors could be used to produce an equivalent torque but to give the fan assembly a smaller overall diameter to facilitate collapsing of the umbrella.

One of ordinary skill, after reading the foregoing specification, will be able to effect various other changes, alterations, and substitutions of equivalents without departing from the broad concepts disclosed. It is therefore intended that the scope of letters patent granted hereon be limited only by the definition contained in the appended claims and the equivalents thereof.

The embodiments of the invention in which an exclusive property or privilege is claimed are defined as follows:

1. A combination canopy and fan, comprising:

(a) a unitary elongate shaft;

(b) a collapsible, domed canopy mounted on the upper end of the shaft;

(c) a fan assembly mounted on the shaft under the canopy, including:

(i) a fan hub mounted axially and rotatably on the shaft;

(ii) a plurality of fan blades secured to the fan hub and extendible radially outward therefore, wherein the fan blades are pivotally secured to the fan hub to pivot between a folded position, in which the blades are folded alongside the shaft, and an extended position, in which the blades extend radially outward from the fan hub;

(iii) biasing means for biasing the fan blades toward the folded position, wherein centrifugal forces generated by rotation of the fan hub overcome the biasing means so that the fan blades pivot to the extended position; and (iv) drive means secured externally alongside the unitary shaft at a location adjacent to and trained with the fan hub for driving rotation of the fan hub; and (d) power means for powering the drive means.

2. The combination canopy and fan of claim 1, wherein the fan blades are folded upwardly alongside the shaft to the folded position.

3. A combination canopy and fan, comprising:

(a) an elongate shaft;

(b) a collapsible, domed canopy mounted on the upper end of the shaft and including:

(i) a plurality of elongate first stays pivotally secured at one end to the upper end of the shaft and extendable generally radially therefrom;

(ii) a corresponding plurality of elongate second stays, each second stay having a first end pivotally secured to a corresponding first stay at a location intermediate the end of the first stay and a second end pivotally secured to a collar mounted axially and slidably on the shaft below the fan assembly, the collar sliding between an upper position, in which the first stays project generally radially from the elongate shaft, and a lower position, in which the first stays are pivoted to lay alongside the elongate shaft; and (iii) a web covering and secured to the first stays;

(c) a fan assembly mounted on the shaft under the canopy, including:

(i) a fan hub mounted axially and rotatably on the shaft;

(ii) a plurality of fan blades secured to the fan hub and extendable radially outward therefrom; and (iii) drive means secured externally to the shaft at a location adjacent to and trained with the fan hub for driving rotation of the fan hub; and (d) power means for powering the drive means, the power means including a power interrupt switch having a first electrical contact mounted on the elongate shaft and a second electrical contact mounted within the collar and disposed such that the second electrical contact contacts the first electrical contact when the collar is in the upper position, thereby enabling power transmission from the power means to the drive means, and power transmission being interrupted when the collar is slid from the upper position.

4. The combination canopy and fan of claim 3, further comprising:

(a) a handle secured to the lower end of the shaft; and (b) a second switch mounted within the handle and operable by a user to selectively supply power to the drive means.

5. The combination canopy and fan of claim 4, wherein the power means includes a battery mounted within the handle.

6. A combination canopy and fan, comprising:

(a) an elongate shaft;

(b) a collapsible, domed canopy mounted on the upper end of the shaft;

(c) a fan assembly mounted on the shaft under the canopy, including:

(i) a fan hub mounted axially and rotatably on the shaft;

(ii) a plurality of fan blades pivotally secured to the fan hub and extendable radially outward therefrom;

(iii) biasing means for biasing the fan blades toward a folded position alongside the shaft, wherein centrifugal forces generated by rotation of the fan hub overcome the biasing means, causing the fan blades to pivot to extend radially outward from the fan hub; and (iv) drive means secured to the shaft and trained with the fan hub for driving rotation of the fan hub; and (d) power means for powering the drive means.

* * * * *